US008562094B2

(12) United States Patent
Ozawa et al.

(10) Patent No.: US 8,562,094 B2
(45) Date of Patent: Oct. 22, 2013

(54) LIQUID EJECTING APPARATUS AND CONTROL METHOD OF LIQUID EJECTING APPARATUS

(75) Inventors: Kinya Ozawa, Shiojiri (JP); Shushi Makita, Shiojiri (JP); Ryoichi Tanaka, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 14 days.

(21) Appl. No.: 13/081,453

(22) Filed: Apr. 6, 2011

(65) Prior Publication Data

US 2011/0249050 A1 Oct. 13, 2011

(30) Foreign Application Priority Data

Apr. 9, 2010 (JP) ..... 2010-090873

(51) Int. Cl.
*B41J 29/38* (2006.01)

(52) U.S. Cl.
USPC ..... 347/10; 347/17

(58) Field of Classification Search
USPC ..... 347/9–12, 17
See application file for complete search history.

(56) References Cited

U.S. PATENT DOCUMENTS

2009/0322816 A1* 12/2009 Ihara ..... 347/14

FOREIGN PATENT DOCUMENTS

JP 2010-030313 A 2/2010

* cited by examiner

*Primary Examiner* — An Do
(74) *Attorney, Agent, or Firm* — Kilpatrick Townsend & Stockton LLP

(57) ABSTRACT

Liquid ejecting apparatus and related methods of operation are disclosed. A liquid ejecting apparatus includes an ejecting head having liquid-ejecting nozzles, a platen disposed to support a recording medium and face the ejecting head, a movement section that moves the ejecting head relative to the platen, a heater that heats the platen, a temperature sensor to detect a temperature of the ejecting head, a driving waveform generation section that generates a driving waveform to drive the ejecting head in accordance with the detected temperature, and a liquid ejection control section that supplies the driving waveform to the ejecting head to eject liquid for printing on the recording medium in a printing area. The driving waveform is generated according to a temperature of the ejecting head that is detected when the ejecting head has come to an area outside the printing area.

17 Claims, 8 Drawing Sheets

LIQUID EJECTING APPARATUS AND CONTROL METHOD OF LIQUID EJECTING APPARATUS

This application claims priority to Japanese Application No. 2010-090873, filed Apr. 9, 2010, the entirety of which is incorporated by reference herein.

BACKGROUND

1. Technical Field

The present invention relates generally to a liquid ejecting apparatus such as an ink jet type printer and a control method thereof, and more particularly to a liquid ejecting apparatus having a heater that heats an ejection target, and a control method thereof.

2. Related Art

A typical liquid ejecting apparatus has a liquid ejecting head with nozzles operable to eject various liquids. For example, an image recording apparatus, such as an ink jet type printer (hereinafter simply referred to as a printer) having an ink jet type recording head (hereinafter simply referred to as a recording head, and can also be referred to as a liquid ejecting head, which ejects ink in the form of a liquid) that records an image or the like by ejecting and landing ink in the form of liquid from nozzles of the recording head onto a recording medium (impact target) such as recording paper, can be given as a representative example of the liquid ejecting apparatus. Liquid ejecting apparatus are not limited to image recording. For example, in recent years, liquid ejecting apparatus have also been used in manufacturing, such as in manufacturing of a color filter of a liquid crystal display or the like.

Recently, printers have been used to perform printing on recording medium larger than the printing paper typically used in a general home printer, for example, an outdoor advertisement or the like. As the recording medium in this case, a resin film which is made of, for example, vinyl chloride can be used to provide weather resistance. A solvent ink containing an organic solvent as its main component can be used to print on such a resin film. The solvent ink has excellent scratch resistance and weather resistance compared to water-based ink.

Incidentally, since it is hard for the resin film to absorb ink, there is concern that a recorded image may bleed. In order to cope with such a problem, the use of a heater (a platen heater) to heat a recording medium on a platen has been proposed, in which the drying and fixing of ink landed on recording paper are promoted by heating of the recording paper by the heater (refer to JP-A-2010-30313, for example).

In the case of printing an advertisement or the like that is even larger than the maximum size of a recording medium capable of being printed by a printer, the advertisement can be partially printed on a roll-shaped film, the film cut and divided after printing into respective parts, and the respective parts can be joined together, thereby creating one sheet of continuous finished product. When, however, a recording medium is heated by the above-described heater, heat from the heater is transmitted to a recording head, whereby the viscosity of ink changes with time. In general, an increase in temperature of the inside of the recording head lowers the viscosity of the ink. If the viscosity of ink is lowered, the amount (weight or volume) of ink ejected at a given pressure is increased. That is, ejection characteristics change in accordance with the temperature. Accordingly, there is concern that the density of an image printed on the film may vary undesirably. As described above, where respective printed parts of an image are joined into one sheet, there is a problem where a difference in density is conspicuous at a boundary portion, thereby resulting in poor image quality. And when the temperature of the recording head is low at the start of the printing relative to the steady state temperature of the recording head, the resulting temperature change can easily cause the above-mentioned problem.

SUMMARY

An advantage of some aspects of the invention is that it provides a liquid ejecting apparatus in which it is possible to suppress variations in the ejection characteristics accompanying a change in temperature, and a control method of a liquid ejecting apparatus.

According to a first aspect of the invention, there is provided a liquid ejecting apparatus including: a recording head in which nozzles, from which liquid is ejected, are provided; a platen provided to face the recording head; a movement section that moves the recording head with respect to the platen; a heater that heats the platen; a temperature sensor mounted in the recording head, thereby detecting the temperature of the recording head; a driving waveform generation section that generates a driving waveform that drives the recording head, in accordance with the detected temperature; and a liquid ejection control section that supplies the driving waveform to the recording head, thereby ejecting liquid for printing in a printing area. The driving waveform generation section generates a driving waveform according to the detected temperature when, for example, the recording head has come to an area outside the printing area.

According to the above aspect of the invention, when the recording head has moved with respect to the platen to outside of the printing area, the temperature sensor can detect the temperature and the driving waveform is corrected in accordance with the temperature detected by the temperature sensor. Accordingly, it becomes possible to suppress variation in discharge characteristics (discharge amount of a liquid droplet, discharge velocity, formation status of a satellite drop, or the like) accompanying a change in temperature. As a result, variations in the density of an image or the like that is recorded on an impact target is suppressed. In particular, it is possible to prevent variations in the color tone of an image or the like despite a rapid change in temperature after the temperature of the recording head rises after the start of the heating of the platen and the detected temperature changes rapidly, and before a steady state or a state close thereto is attained.

Also, if the recording head is in the printing area, in a case such as during a rise in temperature of the platen, which is heated by the platen heater, since the temperature of the recording head, which faces the platen, is also rising, the detected temperature is not constant and unstable detection may be made. However, if the recording head is outside the printing area (for example, in a place that does not face the platen), such a defect does not arise.

In the above aspect, it is preferable that the temperature detection section detect the temperature in a state of low velocity compared to the velocity in the printing area, at a timing where the recording head moves relatively to the outside of the printing area, then decelerates or stops (appears to stop), and accelerates back towards the printing area.

According to the above configuration, since the temperature is detected at a timing when the recording head relatively moves outside the printing area and then in a low velocity state or has stopped, electrical noise caused by mechanical friction, vibration, or the like, which is generated with relative movement of the recording head, is reduced or disappears in a detection signal, so that superposition of such noise on the detection signal is prevented. As a result, it is possible to more precisely detect the temperature.

Also, in the above case, the temperature detection section may detect the temperature of the recording head in a period after the recording head relatively moves with respect to the platen, thereby coming outside the printing area and before the recording head enters into the printing area again with a relative movement direction reversed, and the driving waveform generation section may perform the generation of the driving waveform before the ejecting head enters into the printing area.

Also, the temperature detection section may perform the temperature detection when relative movement when reversing the direction of a relative movement is stopped after the recording head relatively moves with respect to the platen, thereby coming outside the printing area.

Also, the liquid ejection control section may perform liquid ejection control so as to eject liquid outside the printing area in order to restore ejection capability, separately from the ejection of liquid for printing in the printing area, and the temperature detection section may detect the temperature of the recording head after the recording head relatively moves with respect to the platen, thereby coming outside the printing area and the liquid ejection for ejection capability restoration is then performed.

According to the above configuration, since the temperature is detected when the recording head has relatively moved outside the printing area and after an ejection capability restoration process has ended, more precise correction can be performed. That is, by performing an ejection capability restoration process, new liquid is introduced from a liquid supply source into a liquid flow path in the recording head. As a result, the temperature of the liquid is lowered. Therefore, by performing temperature detection after the ejection capability restoration process, it is possible to detect a more precise temperature.

Also, in the above configuration, a configuration may also be adopted in which the recording head stops once an ejection operation in the printing area, the temperature detection section detects the temperature in the stopped state of the recording head, and the driving waveform generation section corrects the driving waveform in accordance with the temperature detected by the temperature detection section.

According to the above configuration, by performing temperature detection and correction of the driving waveform in the printing area, it is also possible to respond to a more significant change in temperature and it becomes possible to more effectively suppress variations in the ejection characteristics accompanying a change in temperature.

Also, in the liquid ejecting apparatus according to the above aspect, the temperature detection section may detect the temperature at the timing of each time the recording head relatively moves outside the printing area.

In doing so, since temperature detection is performed every time the recording head relatively moves with respect to the platen so as to move from end to end in a so-called scanning direction for printing, temperature detection or correction of the driving waveform according to it can be promptly performed and printing unevenness is reduced.

Also, within a usage temperature range of the liquid ejecting apparatus, the liquid may be a liquid having a tendency towards high viscosity at low temperature and low viscosity at high temperature, and when the temperature which is detected by the temperature detection section is high, the driving waveform generation section may make the amplitude of the driving voltage small compared to the driving voltage in a case where the detected temperature is low.

According to a second aspect of the invention, there is provided a control method of a liquid ejecting apparatus, which includes a recording head in which nozzles, from which liquid is ejected, are provided; a platen provided to face the recording head; a movement section that moves the recording head with respect to the platen; a heater that heats the platen; a temperature sensor mounted in the recording head, thereby detecting the temperature of the recording head; a driving waveform generation section that generates a driving waveform that drives the recording head, in accordance with the detected temperature; and a liquid ejection control section that supplies the driving waveform to the recording head, thereby ejecting liquid for printing in the printing area. The method includes: detecting a temperature of the recording head by using the temperature sensor when the recording head has come to an area outside the printing area; and generating the driving waveform in the driving waveform generation section according to the detected temperature.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the best mode for carrying out the invention will be described with reference to the accompanying drawings. In addition, although in embodiments which are described below, various limitations are given as preferred specific examples of the invention, the scope of the invention is not to be limited to these aspects unless the description of intent to limit the invention is particularly provided in the following explanation. Also, in the following, as a liquid ejecting apparatus according to the invention, an ink jet type recording apparatus (hereinafter referred to as a printer) is taken and described as an example. Although in the following examples, an ink jet printer which ejects ink by using a piezoelectric vibrator is taken and described as an example, a liquid ejecting apparatus which performs boiling by applying heat to liquid and ejects ink by using the force may also be adopted. Also, not only a configuration in which a recording head moves with respect to a platen, but also a configuration in which the platen side moves with respect to a recording head may be adopted.

Figure 1:
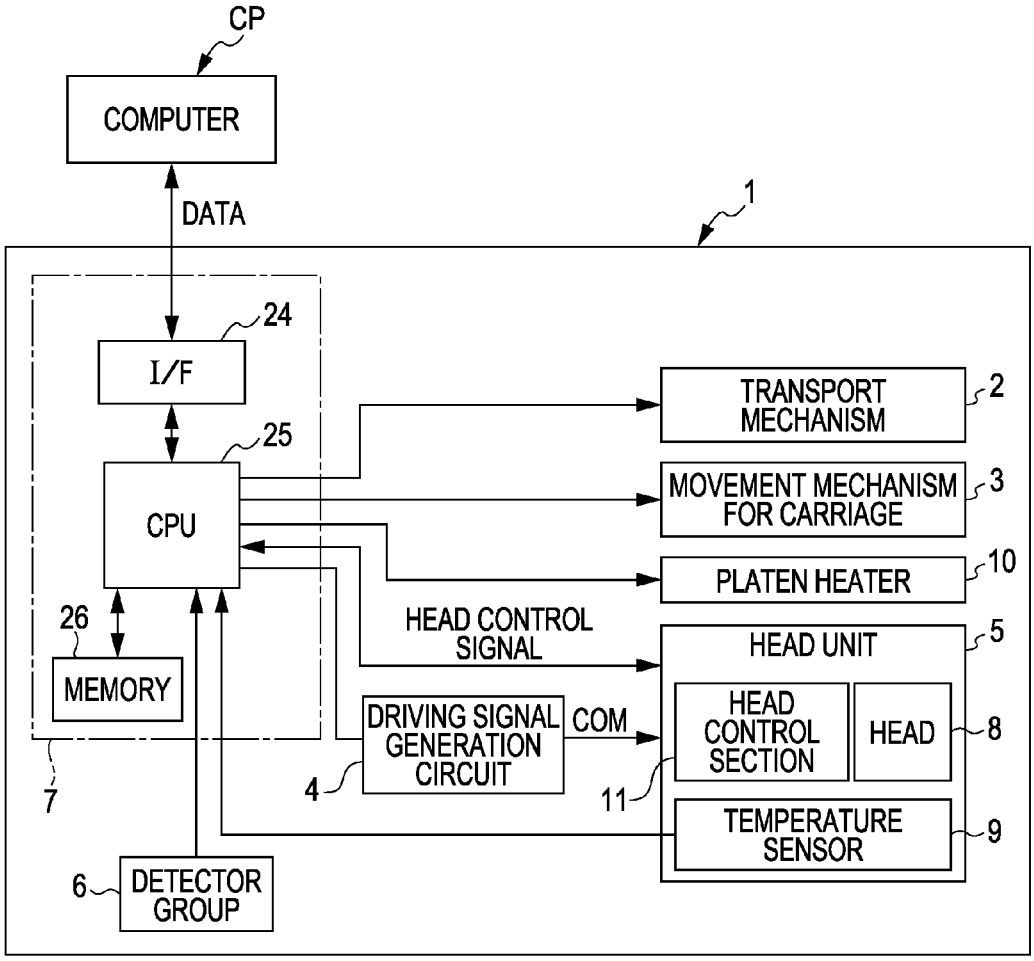
FIG. 1 is a block diagram illustrating the electrical configuration of a printer, in accordance with an embodiment.
Figure 2A:
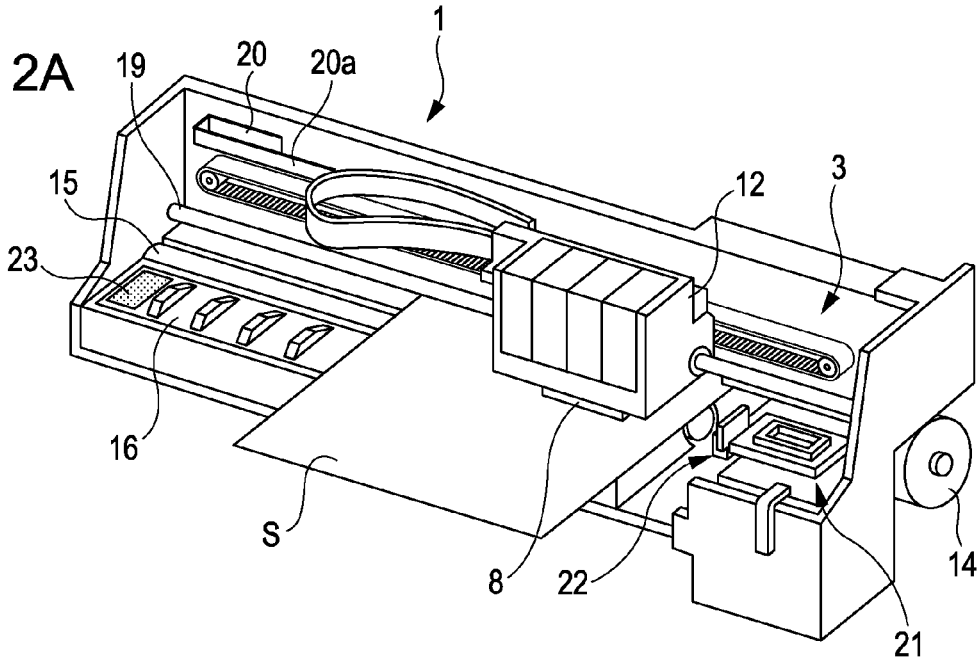
FIGS. 2A to 2C are views illustrating the internal configuration of the printer of FIG. 1.
Figure 2B:
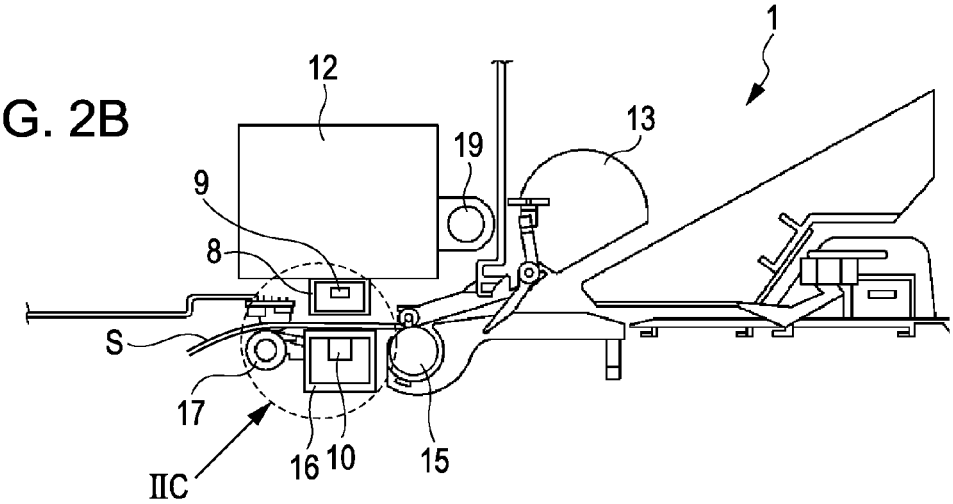
Figure 2C:
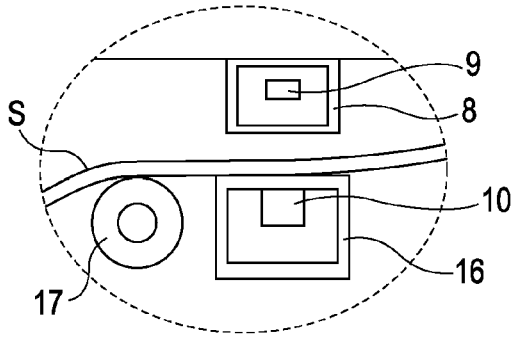

FIG. 1 is a block diagram explaining the electrical configuration of a printer 1. Also, FIGS. 2A to 2C are views explaining the internal configuration of the printer 1, wherein FIG. 2A is a perspective view, FIG. 2B is a transverse cross-sectional view, and FIG. 2C is an enlarged view of the surroundings of a platen 16 in FIG. 2B.

The illustrated printer 1 ejects ink, which is one type of liquid, toward a recording medium S such as recording paper, cloth, or a resin film. The recording medium S is an impact target which becomes a target on which liquid is ejected and landed. A computer CP as an external device is connected to the printer 1 so as to be able to communicate therewith. In order to make the printer 1 print an image, the computer CP transmits printing data according to the image to the printer 1.

The printer 1 in this embodiment includes a transport mechanism 2, a movement mechanism for carriage 3 (one type of a movement section), a driving signal generation circuit 4 (one type of a driving waveform generation section), a head unit 5, a detector group 6, a platen heater 10, and a printer controller 7. The transport mechanism 2 transports the recording medium S in a transport direction. The movement mechanism for carriage 3 moves a carriage, on which the head unit 5 is mounted, in a given moving direction (for example, a paper-width direction). The driving signal generation circuit 4 includes a DAC (Digital Analog Converter) (not shown) and generates an analog voltage signal on the basis of waveform data relating to the waveform of a driving signal sent from the printer controller 7. Also, the driving signal generation circuit 4 also includes an amplifier circuit (not shown) and power-amplifies a voltage signal from the DAC, thereby generating a driving signal COM. The driving signal COM (the driving waveform) is applied to a piezoelectric vibrator 32 (refer to FIG. 3) of a recording head 8 at the time of a printing process (a recording process or an ejection process) on the recording medium and is a successive signal which includes at least one or more of ejection pulse PS in a unit period that is a repetition period of the driving signal COM, as shown as one example in FIGS. 4A and 4B. Here, the ejection pulse PS is for making a given operation be performed in the piezoelectric vibrator 32 in order to eject ink of a droplet shape from the recording head 8. In addition, the details of the ejection pulse PS will be described later.

Figure 3:
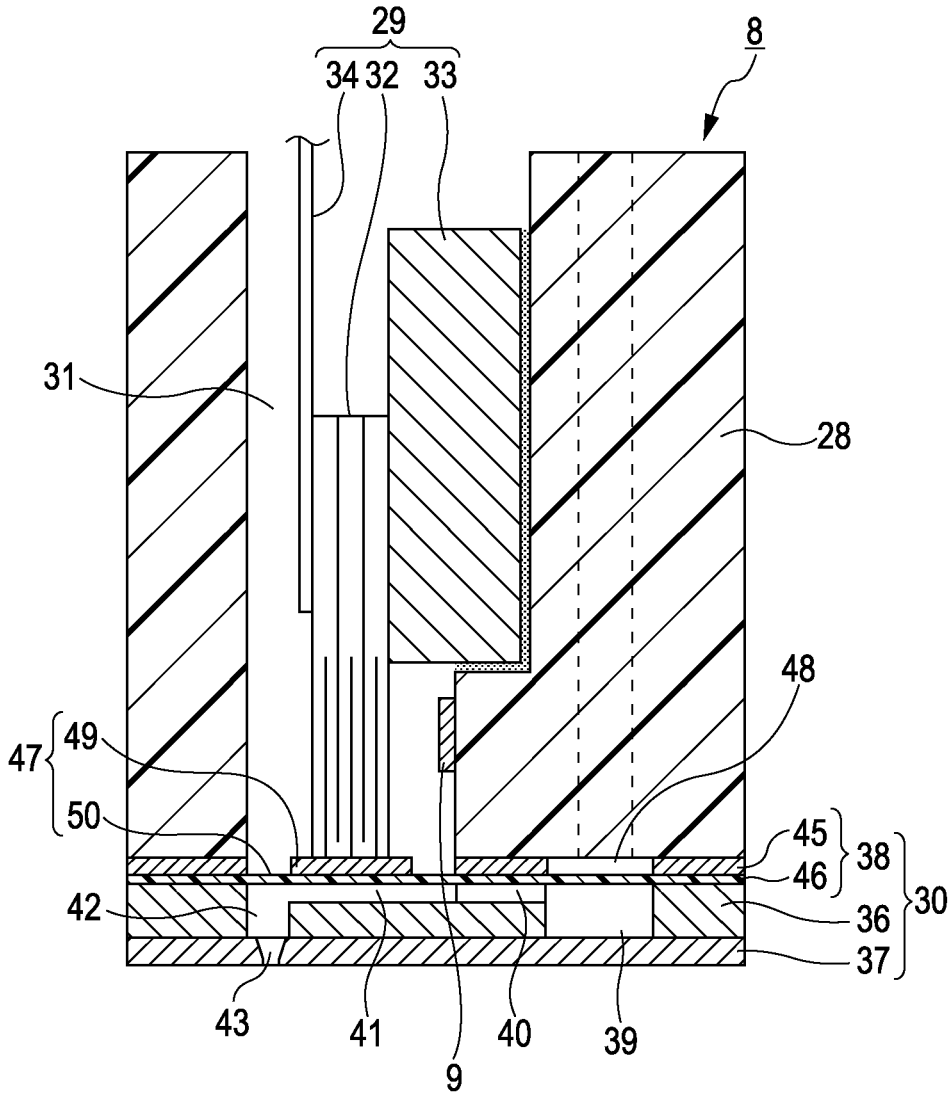
FIG. 3 is a cross-sectional view of a main section of a recording head of the printer of FIG. 1.

The head unit 5 includes the recording head 8, a head control section 11, and a temperature sensor 9 (one type of a temperature detection section). The recording head 8 is one type of a liquid ejecting head and ejects ink toward the recording medium, thereby making it land on the recording medium, thereby forming a dot. An image or the like is recorded on the recording medium S by arranging a plurality of dots in a matrix form. The head control section 11 controls the recording head 8 on the basis of a head control signal from the printer controller 7. The temperature sensor 9 is constituted by a thermistor and provided in a storage hollow portion 31 of a case 28 of the recording head 8, as shown in FIG. 3. The temperature sensor 9 detects the temperature of the inside of the recording head 8 and outputs a detection signal to a CPU 25 side of the printer controller 7 as temperature information. In addition, the configuration of the recording head 8 will be described later. The detector group 6 is constituted by a plurality of detectors which monitors the circumstances of the printer 1. Detection results by these detectors are output to the printer controller 7. The printer controller 7 performs overall control in the printer 1.

The transport mechanism 2 is a mechanism for transporting the recording medium S in a direction (hereinafter referred to as a transport direction) perpendicular to the scanning direction of the recording head 8. The transport mechanism 2 includes a paper feed roller 13, a transport motor 14, a transport roller 15, the platen 16, and a paper discharge roller 17. The paper feed roller 13 is a roller for feeding the recording medium S into the printer. The transport roller 15 is a roller which transports the recording medium S fed by the paper feed roller 13, up to above the platen 16 that is a printable area, and is driven by the transport motor 14. The platen 16 supports the recording medium S during printing. The platen 16 has a platen heater 10 in the inside thereof. The paper discharge roller 17 is a roller which discharges the recording medium S to the outside of the printer, and is provided on the downstream side in the transport direction with respect to the printable area. The paper discharge roller 17 rotates in synchronization with the transport roller 15.

The printer controller 7 is a control unit for performing control of the printer. The printer controller 7 includes an interface section 24, the CPU 25, and a memory 26. The interface section 24 performs transmission and reception of state data of the printer, such as the sending of printing data or printing instructions from the computer CP to the printer 1 and the receiving of state information of the printer 1 by the computer CP, between the computer CP that is an external device and the printer 1. The CPU 25 is an arithmetic processing device for performing control of the entire printer. The memory 26 is for securing an area which stores a program of the CPU 25, a working area, or the like and includes a storage element such as a RAM or an EEPROM. The CPU 25 controls each unit in accordance with a program stored in the memory 26.

The platen heater 10 is a device for heating the recording medium S which passes over the platen 16. The platen heater 10 is connected to the printer controller 7, starts heating along with powering-on of the printer 1, and is controlled so as to reach a predetermined temperature (for example, in the range of 40° C. to 50° C.). The platen heater 10 is provided at a position that faces the recording head 8, which will be described later, and is made so as to be able to heat the recording medium S which passes over the platen 16, by heating the platen 16. Also, the platen heater 10 is equivalent to a heater in the invention.

As shown in FIGS. 2A to 2C, a carriage 12 is mounted in a state where it is supported on a guide rod 19 provided to extend in a main scanning direction, and is constituted so as to reciprocate in the main scanning direction perpendicular to the transport direction of the recording medium S along the guide rod 19 by an operation of the movement mechanism for carriage 3. A position in the main scanning direction of the carriage 12 is detected with use of a linear encoder 20 and a detection signal thereof, that is, an encoder pulse (one type of position information) is transmitted to the CPU 25 of the printer controller 7. The linear encoder 20 is one type of a position information output section and outputs an encoder pulse according to a scanning position of the recording head 8 as position information in the main scanning direction. The linear encoder 20 in this embodiment includes a scale 20*a* (encoder film) provided inside a housing of the printer 1 so as to extend in the main scanning direction, and a photo-interrupter (not shown) mounted on the back face of the carriage 12. The scale 20*a* is a strip-shaped (band-shaped) member made of a transparent resin film, and is, for example, a member in which a plurality of opaque stripes, which traverses in a band-width direction, is printed on the surface of a transparent base film. The respective stripes have the same width and are formed at a constant pitch, for example, a pitch equivalent to 180 dpi, in the band-length direction. Also, the photo-interrupter is constituted by a pair of light-emitting and light-receiving elements which is disposed to face each other, and is made so as to output an encoder pulse in accordance with the difference between the light-receiving state in a transparent portion of the scale 20*a* and the light-receiving state in a stripe portion.

Since the stripes having the same width are formed at a constant pitch, if the movement velocity of the carriage 12 is constant, the encoder pulses are output at regular intervals, whereas, in a case where the movement velocity of the carriage 12 is not constant (during acceleration or during deceleration), an encoder pulse interval varies according to the movement velocity of the carriage. Then, the encoder pulse is input to the CPU 25. For this reason, the CPU 25 can recognize a scanning position of the recording head 8 mounted on the carriage 12 on the basis of the received encoder pulse. That is, for example, by counting the received encoder pulses, it is possible to recognize the position of the carriage 12. Accordingly, the CPU 25 can control a recording operation of the recording head 8 while recognizing the scanning position of the carriage 12 (the recording head 8) on the basis of the encoder pulse from the linear encoder 20.

At an end area (the area on the right front side in FIG. 2A) outside a recording area in the movement range of the carriage 12, a home position which becomes the base point of the scanning of the carriage is set up. At the home position in this embodiment, a capping member 21 which seals a nozzle formation face (a face on an ejection side of a nozzle plate 37; refer to FIG. 3) of the recording head 8, and a wiper member 22 for wiping the nozzle formation face are disposed. Then, the printer 1 is configured so as to be able to perform a so-called bi-directional recording process (printing process or ejecting process) which records a character, an image, or the like on the recording medium S at both the time of forward movement in which the carriage 12 moves from the home position toward an end portion (hereinafter referred to as a full-position) on the opposite side and the time of return movement in which the carriage 12 returns from the full-position to the home position side.

Also, in the printer 1 in this embodiment, in a state where the recording head 8 is moved up to above the capping member 21 (one type of a liquid receiving section) at the home position or an ink receiving section 23 (one type of a liquid receiving section) provided on the platen 16 at the full-position on the opposite side to the home position during printing, whereby the nozzle face faces the capping member 21 or the ink receiving section 23, flushing is carried out toward these liquid receiving sections. In the flushing, for the purpose of restoring ejection characteristics (amount or flight velocity of ejected ink) lowered due to thickening of ink or retention of air bubbles to a target value in design, thickened ink or air bubbles are forcibly ejected from the nozzles and removed. Therefore, the flushing is one type of an ejection capability restoration process.

Next, the configuration of the recording head 8 will be described with reference to FIG. 3.

The recording head 8 includes the case 28, a vibrator unit 29 which is stored in the case 28, a flow path unit 30 which is bonded to the bottom face (leading end face) of the case 28, and the like. The case 28 is made of, for example, epoxy system resin and in the inside thereof, the storage hollow portion 31 for storing the vibrator unit 29 is formed. The vibrator unit 29 includes the piezoelectric vibrator 32 which functions as one type of a pressure generation section, a fixed plate 33, to which the piezoelectric vibrator 32 is bonded, and a flexible cable 34 for supplying a driving signal or the like to the piezoelectric vibrator 32. The piezoelectric vibrator 32 is a piezoelectric vibrator of a longitudinal vibration mode (electric field transverse effect type) which is a lamination type made by carving a piezoelectric plate, in which a piezoelectric body layer and an electrode layer are alternately stacked, into a comb-tooth shape and can extend or contract in a direction perpendicular to the lamination direction (an electric field direction). Also, the temperature sensor 9 is attached to an inner wall surface of the case 28 between the fixed plate 33 and a vibration plate 38 in the storage hollow portion 31.

The flow path unit 30 is constituted by bonding the nozzle plate 37 to a face on one side of a flow path substrate 36 and bonding the vibration plate 38 to a face on the other side of the flow path substrate 36. At the flow path unit 30, a reservoir 39 (a common liquid chamber), an ink supply port 40, a pressure chamber 41, a nozzle communication port 42, and a nozzle 43 are provided. Then, a successive flow path which extends from the ink supply port 40 to the nozzle 43 through the pressure chamber 41 and the nozzle communication port 42 is formed corresponding to each nozzle 43.

The nozzle plate 37 is a member, in which a plurality of nozzles 43 is perforated in a row shape at a pitch (for example, 180 dpi) corresponding to the dot formation density, and in this embodiment, it is made of stainless steel, for example. Also, the nozzle plate 37 is sometimes made of a silicon single-crystal substrate. The vibration plate 38 has a double structure in which an elastic body film 46 is laminated on the surface of a support plate 45. In this embodiment, the vibration plate 38 is made by using a composite plate material in which a stainless plate that is one type of a metal plate is used as the support plate 45 and a resin film as the elastic body film 46 is laminated on the surface of the support plate 45. At the vibration plate 38, a diaphragm portion 47 which changes the volume of the pressure chamber 41 is provided. Also, at the vibration plate 38, a compliance portion 48 which seals a portion of the reservoir 39 is provided.

The diaphragm portion 47 is made by partially removing the support plate 45 by an etching process or the like. That is, the diaphragm portion 47 is composed of an island portion 49, to which a leading end face of a free-end portion of the piezoelectric vibrator 32 is bonded, and a thin-walled elastic portion 50 surrounding the island portion 49. The compliance portion 48 is made by removing the support plate 45 of an area facing the opening face of the reservoir 39 by an etching process or the like similarly to the diaphragm portion 47 and functions as a damper which absorbs pressure fluctuation of liquid stored in the reservoir 39.

Then, since the leading end face of the piezoelectric vibrator 32 is bonded to the island portion 49, the volume of the pressure chamber 41 can be varied by extending and contracting the free-end portion of the piezoelectric vibrator 32. Pressure fluctuation occurs in the ink in the pressure chamber 41 in accordance with the volume variation. Then, the recording head 8 is made so as to eject an ink droplet from the nozzle 43 by using the pressure fluctuation.

Figure 4A:
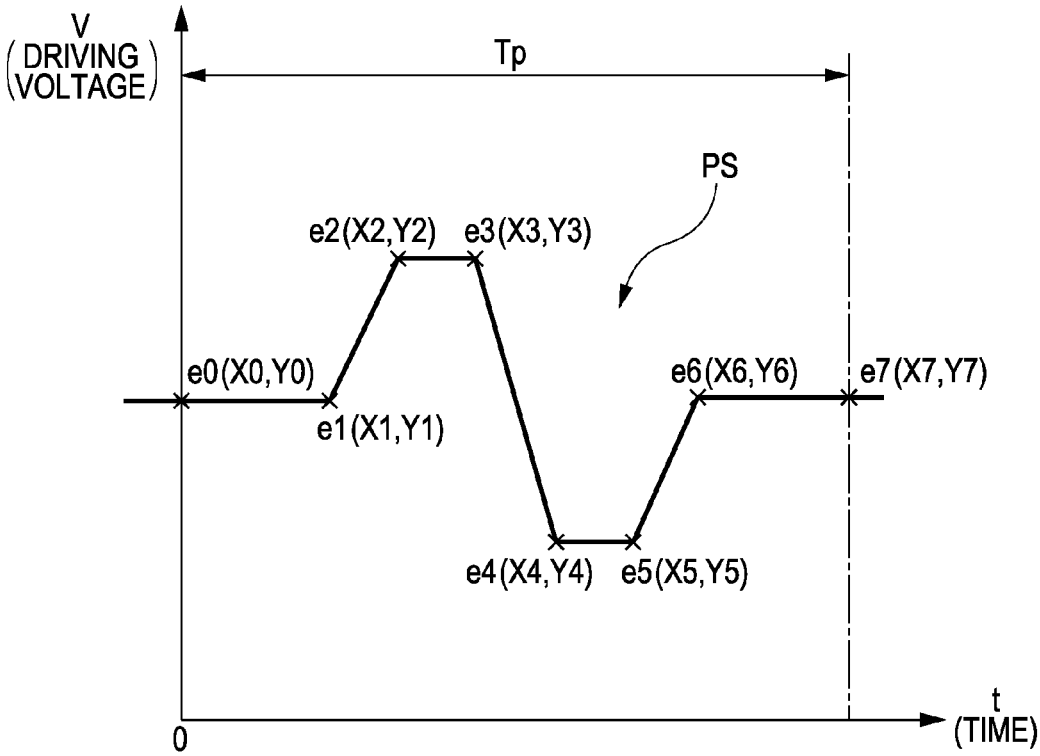
FIGS. 4A and 4B are waveform diagrams illustrating the configuration of an ejection pulse, in accordance with an embodiment.
Figure 4B:
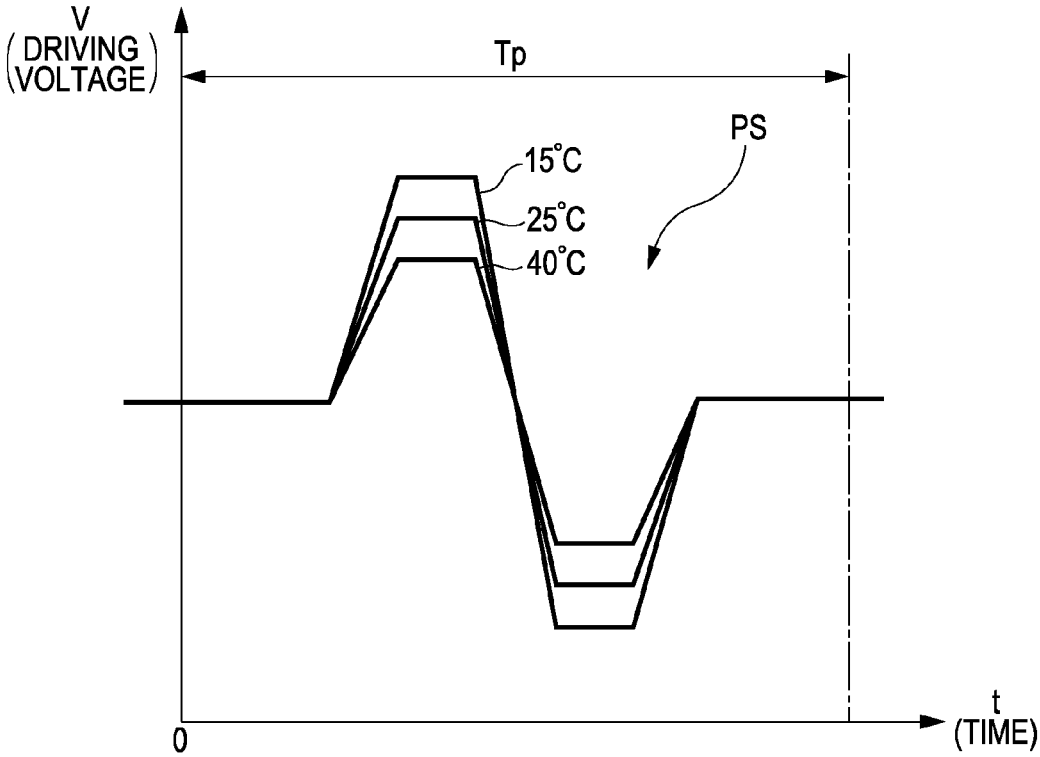

FIGS. 4A and 4B are diagrams explaining a waveform example of the ejection pulse PS which is included in the driving signal COM which is generated by the driving signal generation circuit 4. The driving signal COM is repeatedly generated from the driving signal generation circuit 4 every unit period that is a repetition period. The unit period corresponds to a period in which the nozzle 43 moves by a distance corresponding to one pixel of the image or the like which is printed on the recording medium S. For example, in a case where the print resolution is 720 dpi, a unit period T is equivalent to a period in which the nozzle 43 moves 1/720 inch with respect to the recording medium S. Then, in this unit period, at least one or more period Tp, which generates the ejection pulse PS, is included. That is, in the driving signal COM, at least one or more ejection pulse PS is included. In addition, the shape of the ejection pulse PS is not limited to the illustrated shape and various waveforms are adopted in accordance with the amount or the like of ink which is ejected from the nozzle 43.

In FIG. 4A, coordinates e0 to e7 in the respective points of the waveform of the ejection pulse PS are shown. When the driving signal COM is generated, coordinate data which defines time and voltage relating to the waveform of such a driving signal is sent from the printer controller 7. That is, an X in the coordinate data expresses a time (elapsed time) when the e0 is set to be the origin (a base point), and a Y expresses voltage (electric potential) in the time. The driving signal generation circuit 4 performs interpolation on coordinate points on the basis of the sent coordinate data, thereby generating a driving signal having a waveform in which the coordinates of each coordinate data are connected to each other. That is, if each coordinate data which is sent from the printer controller 7 is changed, the waveform of the ejection pulse also changes accordingly.

For example, when an increase in the amplitude of the ejection pulse is desired, the values of voltage Y2 at the e2 and voltage Y3 at the e3 are increased and the values of voltage Y4 at the e4 and voltage Y5 at the e5 are lowered. By doing so, since the amplitude of the ejection pulse becomes large, the applied displacement of the piezoelectric vibrator 32 becomes larger. Also, when a reduction of the amplitude of the ejection pulse is desired, the values of the voltage Y2 at the e2 and the voltage Y3 at the e3 are reduced and the values of the voltage Y4 at the e4 and the voltage Y5 at the e5 are increased. By doing so, since the amplitude of the ejection pulse becomes small, the applied displacement of the piezoelectric vibrator 32 is decreased. Then, it is possible to generate a desired ejection pulse. Also, it is also possible to change a slope of a change in electric potential without changing voltage. For example, it is possible to make the slope of the change in electric potential steep by making the value of a time X1 at the e1 large or making the value of a time X4 at the e4 small. As a result, the applied displacement of the piezoelectric vibrator 32 becomes steeper. Conversely, it is possible to make the slope of the change in electric potential gentle by making the value of the time X1 at the e1 small or making the value of the time X4 at the e4 large. As a result, the applied displacement of the piezoelectric vibrator 32 becomes gentler.

Incidentally, ink which is used in this embodiment changes in viscosity in accordance with the temperature thereof. If the viscosity of ink is low, an ink droplet is easily ejected from the nozzle. However, if the viscosity of ink becomes high, it is hard for an ink droplet to be ejected from the nozzle. For this reason, if the temperature of ink is different, in a case where the same driving signal (ejection pulse) is applied to the piezoelectric vibrator 32, the ejection amount of an ink droplet becomes different. Specifically, even in a case where an ejection pulse having the same waveform is applied to the piezoelectric vibrator 32, if the temperature is high, an ink droplet of a size larger than that when the temperature is low is ejected. In this manner, if the ejection amount of an ink droplet differs according to the temperature, the density of an image which is formed on the recording medium S changes in accordance with the temperature. In the printer 1 in this embodiment, since the heating of the platen heater 10 is started along with powering-on, heat from the platen heater 10 is transmitted to the recording head 8, whereby the viscosity of ink changes. Specifically, the viscosity is reduced.

Figure 5:
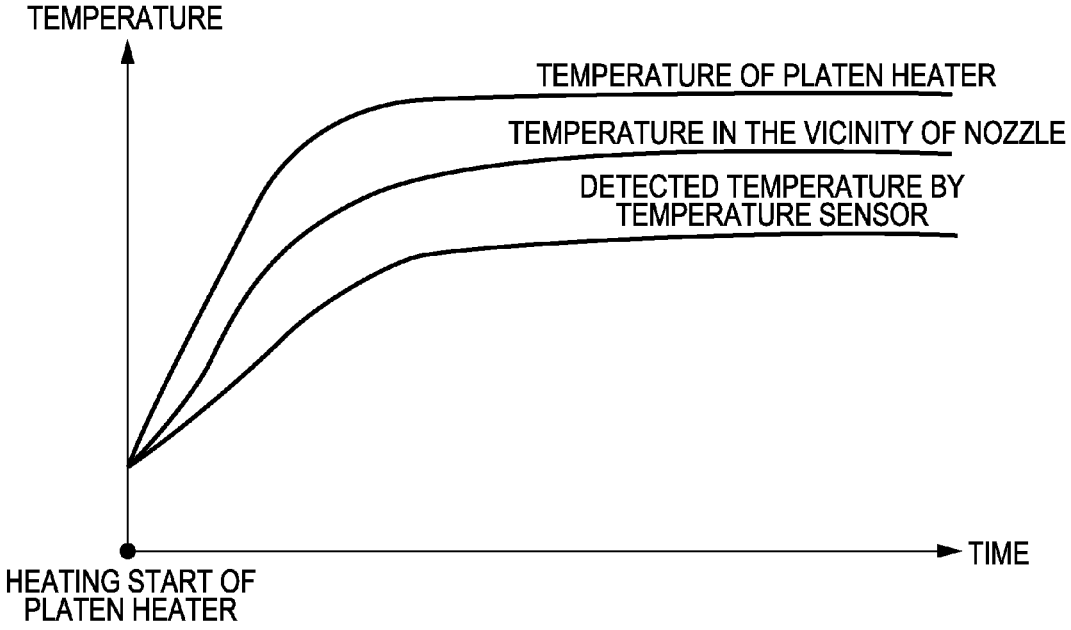
FIG. 5 is a graph showing changes of the temperature of a platen heater, the temperature in the vicinity of a nozzle of the recording head, and the temperature which is detected by a temperature sensor, for the printer of FIG. 1.

FIG. 5 is a graph showing changes of the temperature of the platen heater 10 after the printer 1 is powered on, the temperature in the vicinity of the nozzle of the recording head 8, and the temperature which is detected by the temperature sensor 9. As shown in this drawing, due to heat from the platen heater 10, the temperature of the inside of the recording head 8 rises with time from a relatively low state at the time of power-on. In addition, in a configuration in which a disposition position of the temperature sensor 9 is at a position distant from the nozzle 43, the temperature of ink in the vicinity of the nozzle 43 has a tendency to be higher than the temperature which is detected by the temperature sensor 9. Since until the temperature (detected temperature by the temperature sensor 9) of the inside of the recording head 8 becomes a steady state, the viscosity of ink remarkably changes, a change in density of an image easily occurs.

In order to prevent such a problem, in the printer 1 of this embodiment, a configuration is made such that the temperature of the inside of the head is detected by the temperature sensor 9 when the recording head 8 has moved further to the outside than the printing area (equivalent to an ejection area) that is an area in which printing of an image or the like is performed on the recording medium S, and the ejection pulse PS which is included in the driving signal COM which is generated from the driving signal generation circuit 4 is corrected in accordance with the detected temperature. In addition, the printing area in this embodiment is an area corresponding to the width (the dimension in the direction perpendicular to the transport direction) of the recording medium S or an area narrower than the width of the recording medium S. The printing area is not limited to an area corresponding to the width of the recording medium S, but sometimes corresponds to, for example, a printing area which is set up by software which is executed in an external device such as the computer CP, or the like.

Figure 6:
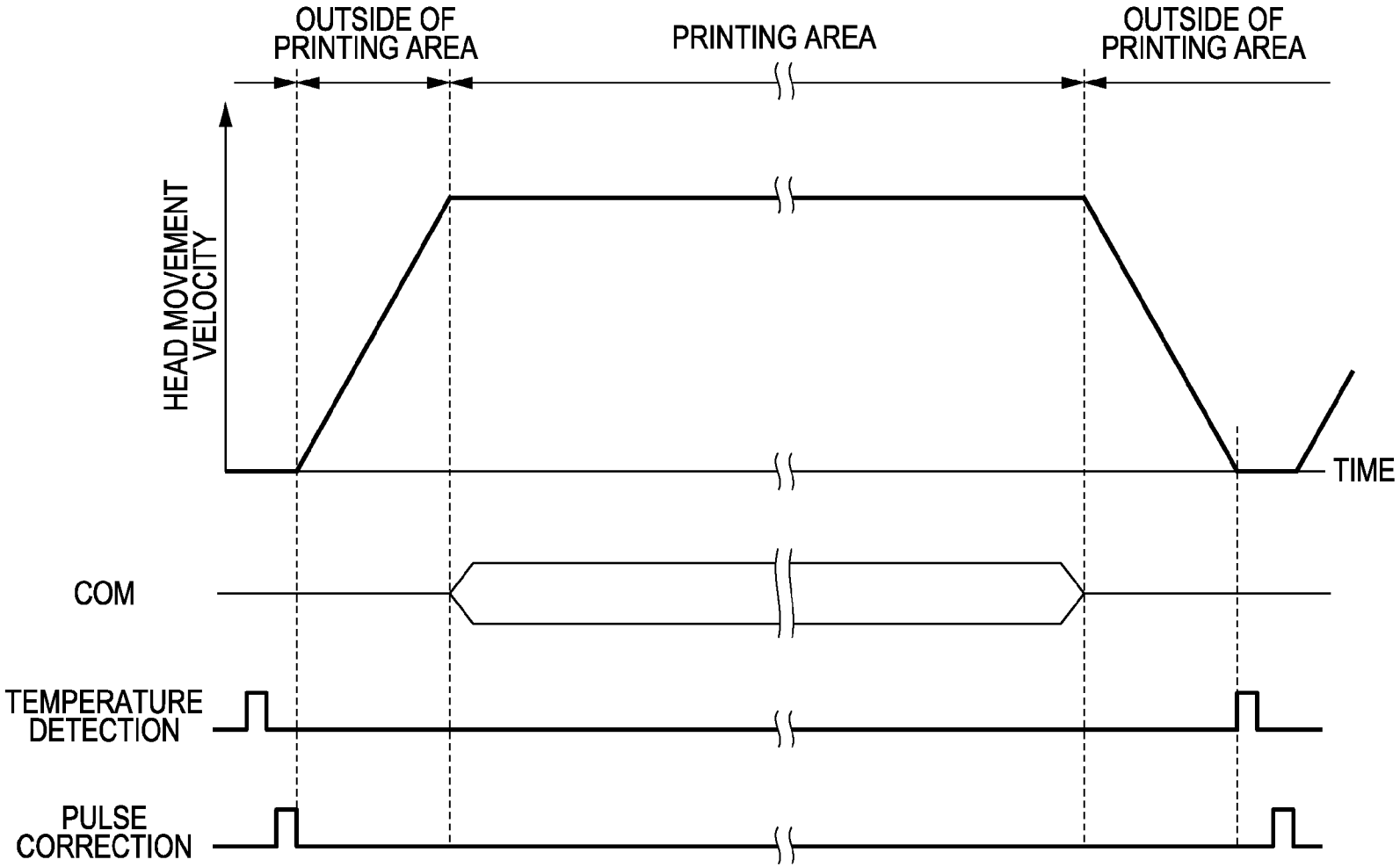
FIG. 6 is a timing chart in which the timing of each of the processes of generation of a driving signal COM, temperature detection, and pulse correction is correlated with a head movement velocity, in accordance with an embodiment.

FIG. 6 is a timing chart showing the timings of the respective processes; generation of the driving signal COM, temperature detection, and pulse correction, to correspond to a movement velocity of the recording head 8 and shows one-way scanning of the recording head 8. In addition, the timings of a temperature detection process and a pulse correction process are shown by rectangular pulses. If a printing process is started, the recording head 8 which has waited at the home position starts to move toward the full-position. Acceleration until the recording head 8 reaches a constant velocity is completed outside the printing area. In the printing area, that is, in an area corresponding to the recording medium S placed on the platen 16, the recording head 8 ejects ink from the nozzle 43 by applying the ejection pulse PS, which is included in the driving signal COM, to the piezoelectric vibrator 32 on the basis of the printing data while performing constant-velocity movement, thereby printing an image or the like on the recording medium S. Then, if the recording head 8 moves further to the outside than the printing area, the recording head 8 stops an ejection operation once and then decelerates, and when changing over the moving direction to the opposite direction, the movement velocity temporarily becomes 0, that is, movement is stopped.

In a period before the detected temperature becomes a steady state, detection of the temperature by the temperature sensor 9 is performed every time the recording head 8 moves outside the printing area (that is, every time it moves from end to end in the main scanning direction). In this embodiment, detection of a temperature by the temperature sensor 9 is performed at a point in time when the recording head 8 has stopped outside the printing area in order to change the moving direction (or a point in time when it seems to have stopped). By performing temperature detection at the timing when movement of the recording head 8 has been stopped, superposition of noise on a detection signal is prevented. As a result, it is possible to detect a more precise temperature. In addition, as noise which is superposed on a detection signal of the temperature sensor 9, noise involved in vibration at the time of movement of the recording head 8 (at the time of movement of the platen 16 in the case of a configuration in which the position of the recording head 8 is fixed and the platen 16 is moved) or noise from a motor of the movement mechanism for carriage 3 can be considered. Therefore, by performing temperature detection at a point in time when the recording head 8 has stopped, it is possible to prevent these effects. Also, if the recording head 8 is in the printing area, in a case such as when the temperature of the platen 16 which is heated by the platen heater 10 is rising, since the temperature of the recording head 8 which faces the platen 16 is also rising, the detected temperature is not constant and unstable detection is made. However, if it is outside the printing area (further, a place which does not face the platen 16), such a defect can be prevented. In addition, a point in time of temperature detection is not limited to a point in time when movement of the recording head 8 has been stopped, and it is also possible to detect the temperature at a timing in a state of low velocity compared to movement velocity in the printing area, where the recording head 8 performs deceleration, stopping, and acceleration in order to change a direction outside the printing area before entering the printing area again.

Following the temperature detection by the temperature sensor 9, correction of the ejection pulse PS (or initial settings at the time of the start of printing) is performed in accordance with the detected temperature in a period before the recording head 8 enters into the printing area again. In the memory 26 of the printer controller 7, a correction formula is stored which defines the amounts of change in the coordinates e0 to e7 in the respective points of a waveform element constituting the ejection pulse PS with respect to the detected temperature by the temperature sensor 9. That is, the ejection pulse PS that the driving signal generation circuit 4 generates in the subsequent printing process is corrected on the basis of the detected temperature and the correction formula, and the driving signal generation circuit 4 generates a driving signal which includes the corrected ejection pulse PS, in the subsequent printing process.

FIG. 4B is a diagram for explaining the ejection pulse PS changed in accordance with the detected temperature by the temperature sensor 9. In the drawing, the ejection pulse PS which is generated when the detected temperature is 15° C., the ejection pulse PS which is generated when the detected temperature is 25° C., and the ejection pulse PS which is generated when the detected temperature is 40° C. are shown. The usage temperature range of the printer 1 is 5° C. to 45° C. As shown in the drawing, setting is made such that compared to the amplitude of the ejection pulse PS in a case where the temperature is low (15° C.), the amplitude of the ejection pulse PS when the temperature is higher (25° C.) than it is small, and in 40° C., the amplitude is further small. In solvent-based ink, if the temperature becomes high in the use temperature range, viscosity decreases, and it is preferable if the amplitude of the driving voltage is decreased accordingly. That is, the higher a temperature which is detected by the temperature sensor 9, the more the driving signal generation circuit 4 which functions as a driving waveform generation section lowers the driving voltage of the ejection pulse PS, thereby making the amplitude small. Then, the driving signal generation circuit 4 generates the driving signal COM which includes an ejection pulse according to the detected temperature. In this way, in a period before the detected temperature by the temperature sensor 9 becomes a steady state (or a state close thereto), temperature detection and correction of an ejection pulse are performed every time the recording head 8 moves outside the printing area. Accordingly, the viscosity of liquid changes in accordance with a change in temperature, so that even in the same driving waveform, a change in an ejection amount of liquid can be suppressed. As a result, variation in density of an image or the like which is printed on the recording medium S is suppressed. In particular, after the printer 1 is powered on, the platen heater 10 starts heating, and then, before the temperature of the platen heater 10 or the recording head 8 reaches a steady state, even at a point in time when a rapid change in temperature occurs, it is possible to prevent variations in the color tone of an image or the like despite a rapid change in temperature until the detected temperature becomes a steady state. Therefore, for example, in a case where an advertisement or the like is partially printed on a recording medium such as a resin film and one sheet of continuous advertisement or the like is finally made by joining the respective parts together, it is possible to reduce differences in the density of an image at a boundary portion of each part. Since temperature detection is performed outside the printing area, the temperature detection or the changing of the driving signal (driving waveform) accordingly is promptly performed and printing unevenness is reduced. Then, after the detected temperature by the temperature sensor 9 becomes a steady state or a state close to a steady state, the temperature detection and correction of the ejection pulse may be continuously performed every time the recording head 8 moves outside the printing area, and, for example, like that the temperature detection and the correction of the pulse are performed only when the recording head 8 has moved outside the printing area on the home position side, they may be performed at intervals. In addition, concerning correction of the ejection pulse PS on the basis of the detected temperature by the temperature sensor 9, it is also acceptable to estimate the temperature in the vicinity of the nozzle from the detected temperature by the temperature sensor 9 and perform correction of the ejection pulse PS on the basis of the estimated temperature.

Figure 7:
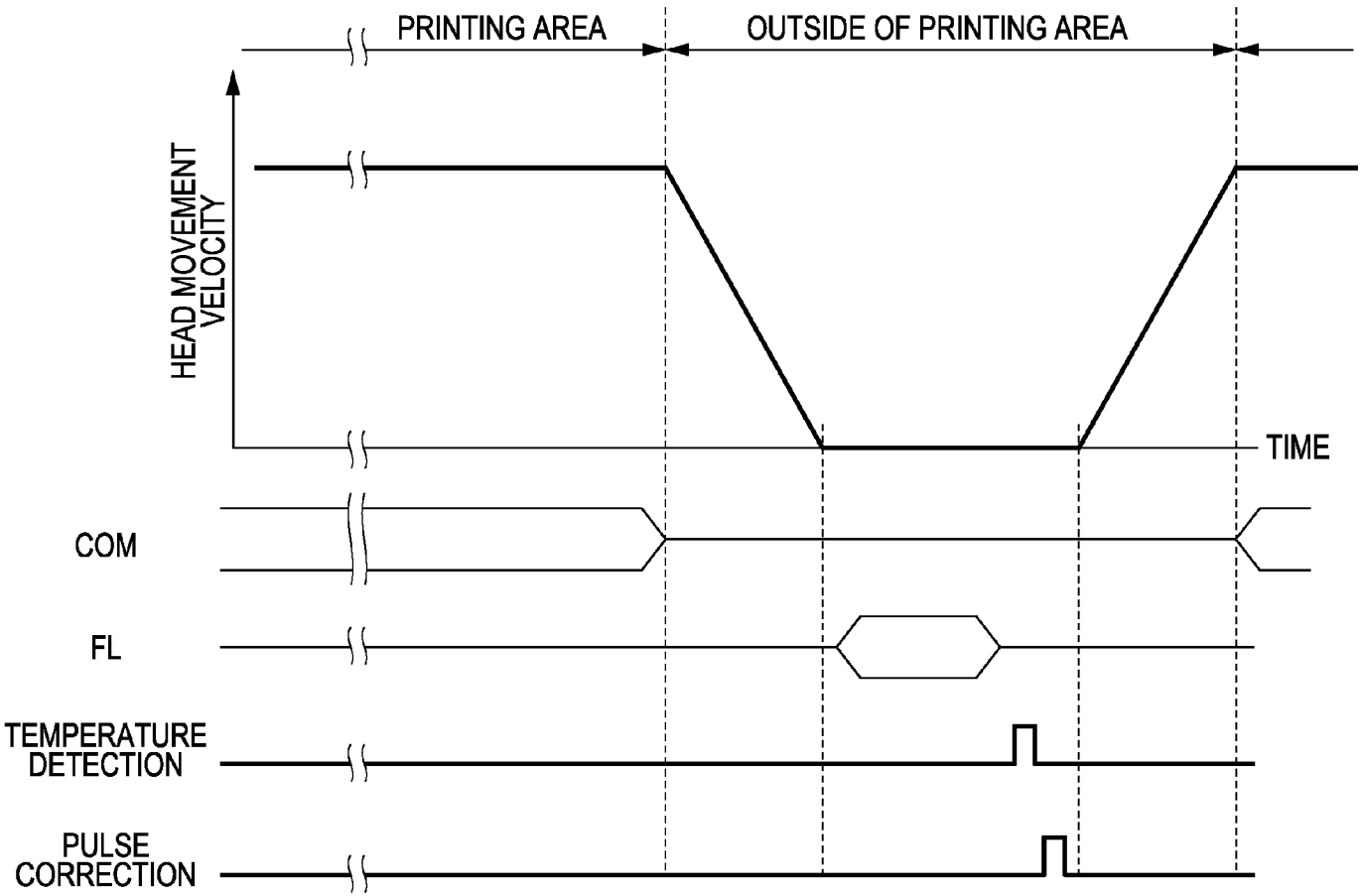
FIG. 7 is a timing chart of the processes in another embodiment.

FIG. 7 is a timing chart showing the timings of various processes in a second embodiment of the invention. A feature of this embodiment is that temperature detection by the temperature sensor 9 and pulse correction are performed after a flushing process (FL) which is performed after interruption of a printing process. Since other configurations and the like are the same as those of the first embodiment described above, the explanation thereof is omitted. The flushing process is for moving the recording head 8 up to above the capping member 21 at the home position or the ink receiving section 23 provided at the full-position on the opposite side to the home position and then ejecting (ejection for ejection capability restoration not related to ejection for printing onto a printing medium) ink from all of the nozzle 43 toward these liquid receiving sections, as described above. By performing the flushing process, new ink is introduced from an ink supply source such as an ink cartridge into an ink flow path in the recording head 8. Accordingly, the temperature of the ink is lowered. Therefore, by performing temperature detection and pulse correction after the flushing process, it is possible to perform more precise correction.

Figure 8:
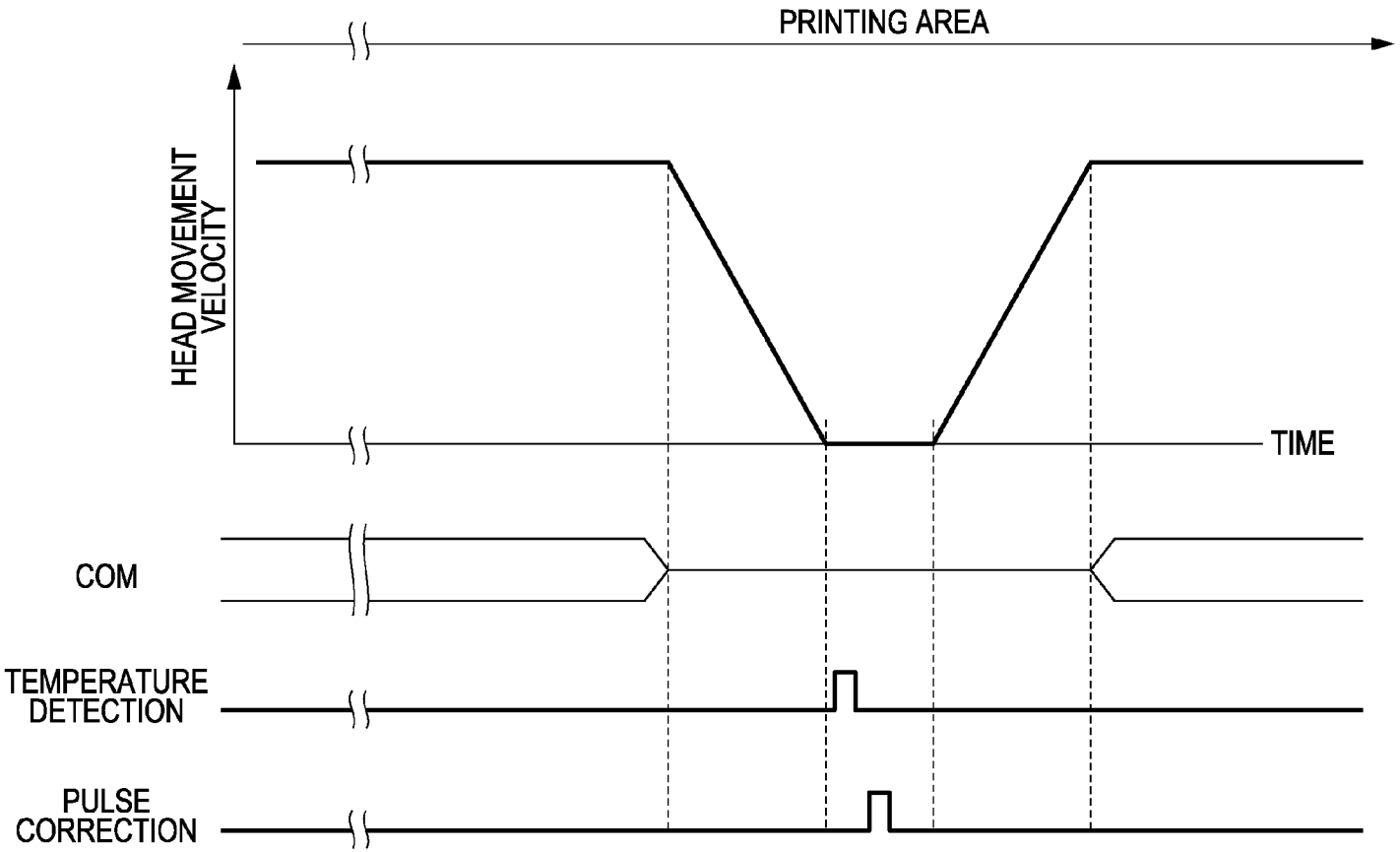
FIG. 8 is a timing chart of the processes in yet another embodiment.

FIG. 8 is a timing chart showing the timings of various processes in a third embodiment of the invention. A feature of this embodiment is that temperature detection by the temperature sensor 9 and pulse correction are performed after movement of the recording head 8 is once stopped during a printing process in a printing area. Since other configurations and the like are the same as those of the first embodiment described above, explanation thereof is omitted. By performing temperature detection and pulse correction also in the printing area in this manner, it is also possible to respond to a more significant change in temperature and it becomes possible to more effectively suppress variation in ejection characteristics accompanying a change in temperature.

In addition, the invention is not to be limited to each embodiment described above and various modifications can be made on the basis of the statement of the claims.

In each embodiment described above, an example has been shown in which temperature detection and pulse correction are performed at a time when movement of the recording head 8 has been stopped. However, it is not limited thereto and it is also possible to perform temperature detection and the like in a state where the recording head 8 is moving. In this case, it is preferable to perform it in a state of as low a velocity as possible so that superposition of noise on the detection signal can be suppressed.

Also, in the above-described embodiments, as the pressure generation section, the piezoelectric vibrator 32 of a so-called longitudinal vibration type has been illustrated. However, it is not limited thereto and it is also possible to adopt, for example, a piezoelectric element of a so-called flexural vibration type. In this case, concerning the ejection pulse PS illustrated in the above-described embodiments, it has a waveform in which a direction of a change in electric potential, that is, up-and-down is reversed.

Further, the pressure generation section is not limited to the piezoelectric vibrator and the invention can also be applied to the cases of using various pressure generation sections such as a heat generation element which generates air bubbles in the pressure chamber, and an electrostatic actuator which changes the volume of the pressure chamber by using an electrostatic force.

Also, in the above description, the ink jet type printer 1 that is one type of the liquid ejecting apparatus has been taken and described as an example. However, the invention can also be applied to a liquid ejecting apparatus which is provided with a heater heating an impact target and performs ejection of liquid while moving a recording head with respect to the impact target. The invention can also be applied to, for example, a display manufacturing apparatus which manufactures a color filter of a liquid crystal display or the like, an electrode manufacturing apparatus which forms an electrode of an organic EL (Electro Luminescence) display, a FED (a surface-emitting display) display, or the like, a chip manufacturing apparatus which manufactures a biochip (a biochemical element), or a micropipette which supplies a very small amount of sample solution in a precise amount.

What is claimed is:

1. A liquid ejecting apparatus comprising:

an ejecting head comprising liquid-ejecting nozzles;

a platen disposed to support a recording medium and face the ejecting head;

a movement section that moves the ejecting head relative to the platen back and forth along a path, wherein the path comprises a first non-printing area at a first end of the path, a second non-printing area at a second end of the path, and a printing area disposed between the first and second non-printing areas;

a heater that heats the platen;

a temperature sensor, wherein, when the movement section has moved the ejecting head out of the printing area into one of the non-printing areas, the temperature sensor is triggered to detect a first temperature of the ejecting head;

a driving waveform generation section that generates a driving waveform to drive the ejecting head in accordance with the first temperature; and a liquid ejection control section that supplies the driving waveform to the ejecting head to eject liquid for printing on the recording medium in the printing area, wherein the ejecting head does not eject liquid onto the medium in the first and second non-printing areas.

2. The liquid ejecting apparatus of claim 1, wherein:

a pulse correction is generated in response to the first temperature, the pulse correction being used to generate the driving waveform.

3. The liquid ejecting apparatus of claim 1, wherein the temperature sensor is triggered to detect the first temperature when movement of the ejecting head relative to the platen has stopped after the movement section has moved the ejecting head out of the printing area and into the one of the non-printing areas.

4. The liquid ejecting apparatus of claim 1, wherein:

the liquid ejection control section performs liquid ejection control so as to eject liquid outside the printing area in order to restore ejection capability, separately from ejection of liquid for printing in the printing area, wherein the liquid ejected outside the printing area does not land on the medium; and the temperature sensor is triggered to detect the first temperature of the ejecting head when the movement section has moved the ejecting head out of the printing area and into the one of the non-printing areas, and after the liquid ejection for ejection capability restoration is performed.

5. The liquid ejecting apparatus of claim 1, wherein:

within a usage temperature range of the liquid ejecting apparatus, the liquid ejected has a viscosity that decreases with increasing temperature;

wherein, when the first temperature is higher than a second, reference temperature, the driving waveform generation section generates the driving waveform to have a first amplitude;

and wherein, when the first temperature is equal to the second temperature, the driving waveform generation section generates the driving waveform to have a second amplitude;

wherein the first amplitude is smaller than the second amplitude.

6. The liquid ejecting apparatus of claim 1, wherein the temperature sensor is triggered to detect the first temperature when the ejecting head is disposed anywhere within the first or the second non-printing area, each time the movement section has moved the ejecting head out of the printing area into either the first or the second non-printing area.

7. A control method of a liquid ejecting apparatus, wherein the liquid electing apparatus comprises an ejecting head having liquid-ejecting nozzles; a platen disposed to support a recording medium and face the ejecting head; a movement section that moves the ejecting head relative to the platen back and forth along a path, wherein the path comprises a first non-printing area at a first end of the path, a second non-printing area at a second end of the path, and a printing area disposed between the first and second non-printing areas; a heater that heats the platen; a temperature sensor to detect a temperature of the ejecting head; a driving waveform generation section that generates a driving waveform to drive the ejecting head; and a liquid ejection control section that supplies the driving waveform to the ejecting head to eject liquid for printing in the printing area, wherein the ejecting head does not eject liquid onto the medium in the first and second non-printing areas, the method comprising:

when the movement section has moved the ejecting head out of the printing area into one of the non-printing areas, triggering the temperature sensor to detect a first temperature of the ejecting head;

when the temperature sensor is triggered, detecting the first temperature of the ejecting head by using the temperature sensor;

generating the driving waveform in the driving waveform generation section according to the first temperature; and driving the ejecting head to eject the liquid in accordance with the driving waveform.

8. The method of claim 7, wherein triggering the temperature sensor to detect the first temperature takes place when the ejecting head is not moving relative to the platen.

9. The method of claim 8, further comprising generating a pulse correction in response to the first temperature, the pulse correction being used to generate the driving waveform.

10. The method of claim 7, further comprising generating a pulse correction in response to the first temperature, the pulse correction being used to generate the driving waveform.

11. A method of operation for a liquid ejecting apparatus, the method comprising:

heating a platen disposed to support a recording medium and face an ejecting head, the ejecting head having liquid-ejecting nozzles;

moving the ejecting head relative to the platen back and forth along a path, wherein the path comprises a first non-printing area at a first end of the path, a second non-printing area at a second end of the path, and a printing area disposed between the first and second non-printing areas;

when the ejecting head has been moved out of the printing area into one of the non-printing areas, triggering detection of a first temperature of the ejecting head;

when the detection is triggered, detecting the first temperature of the ejecting head; and generating a driving waveform that causes the ejecting head to eject liquid in accordance with the first temperature so as to account for a temperature dependent property of the ejected liquid, wherein the ejecting head does not eject liquid onto the medium in the first and second non-printing areas.

12. The method of claim 11, wherein viscosity is the temperature dependent property.

13. The method of claim 11, wherein triggering the temperature sensor to detect the first temperature takes place when the ejecting head is not moving relative to the platen.

14. The method of claim 13, further comprising generating a pulse correction in response to the first temperature, the pulse correction being used to generate the driving waveform.

15. The method of claim 11, further comprising generating a pulse correction in response to the first temperature, the pulse correction being used to generate the driving waveform.

16. A method of operation for a liquid ejecting apparatus, the method comprising:

heating a platen disposed to support a recording medium and face an ejecting head, the ejecting head having liquid-ejecting nozzles;

moving the ejecting head relative to the platen back and forth along a path, when the ejecting head is not moving relative to the platen, triggering detection of a first temperature of the ejecting head;

when the detection is triggered, detecting the first temperature of the ejecting head; and generating a driving waveform that causes the ejecting head to eject liquid in accordance with the first temperature so as to account for a temperature dependent property of the ejected liquid.

17. The method of claim 16, wherein the path comprises a first non-printing area at a first end of the path, a second non-printing area at a second end of the path, and a printing area disposed between the first and second non-printing areas, wherein the ejecting head does not eject liquid onto the medium in the first and second non-printing areas, and wherein triggering detection of the first temperature of the ejecting head takes place when the ejecting head is disposed in the printing area.

* * * * *